US005309589A

United States Patent [19]

Ferrari et al.

[11] Patent Number: 5,309,589

[45] Date of Patent: May 10, 1994

[54] AUTOMATIC CARDING MACHINE FOR FOOTWEAR UPPERS AND THE LIKE

[75] Inventors: Roberto Ferrari; Mario Pagani; Doriano Varini, all of Vigevano, Italy

[73] Assignee: Sagitta Officina Meccanica S.p.A., Vigevano, Italy

[21] Appl. No.: 970,270

[22] Filed: Nov. 2, 1992

[30] Foreign Application Priority Data

Nov. 4, 1991 [IT] Italy ..... MI91 A 002921

[51] Int. Cl.[5] ..... A43D 95/16

[52] U.S. Cl. ..... 12/78; 12/77

[58] Field of Search ..... 12/77, 78, 70, 79.3; 69/6.5

[56] References Cited

U.S. PATENT DOCUMENTS 3,645,118 2/1972 Babson ..... 69/6.5
4,555,823 12/1985 Pedretti et al. ..... 12/77
4,649,585 3/1987 Petrzelka et al. ..... 12/77 X
4,691,398 9/1987 Kadogawa et al. ..... 12/78 X
4,724,562 2/1988 Petrzelka et al. ..... 12/77 X
4,970,745 11/1990 Davies ..... 12/77

*Primary Examiner*—Paul T. Sewell
*Assistant Examiner*—Ted Kavanaugh
*Attorney, Agent, or Firm*—Buckman and Archer

[57] ABSTRACT

Automatic carding machine for uppers including a carriage upholding the upper to be scraped and travelling longitudinally along guides constrained to the top of the machine. The upper sector of the carriage runs on similar guides transversely. The movements can be performed simultaneously by means of independent activation members and the carriage translation speed as well as the upper sector are programmable so that the card can intervene in variable measure on the different peripheral parts of the upper arranged on the carriage. The tool or card automatically reverses its direction of rotation so as to roughen the back of the shoe from the outside toward the inside.

9 Claims, 3 Drawing Sheets 22
24
18
16
26
34'
48
Y
50
49
52
42
47
50
41
30
28
37
32
32
37
30
36
12

AUTOMATIC CARDING MACHINE FOR FOOTWEAR UPPERS AND THE LIKE

FIELD OF THE INVENTION

The present invention relates to an automatic carding machine for footwear uppers and the like.

Industrial manufacturing of footwear contemplates many operations performed on specific machine tools which execute for example preliminary cutting of the skin, hemming, trimming, etc.

Among these various operations is included the so-called carding or scraping of the uppers consisting of progressive roughening of the back of the footwear along the marginal portions. To the back thus roughened is then glued the sole which must adhere perfectly to the upper.

It is thus necessary that the marginal portions of the upper be appropriately leveled and made lumpy in order to create an optimal base for coupling and gluing of the sole.

BACKGROUND OF THE INVENTION

The carding operation is conventionally performed by means of one or more rotating circular tools in the form of brushes with metal bristles or cards from which is derived the name of carder for the machine designed for this work.

Known carding machines are structured in such a manner as to complete the carding through the movement of a carriage on which is arranged the back of the footwear and the tool-holder arm is provided with a brush which moves transversely or along a direction forming a certain angle to the axis of travel of said carriage.

In some embodiments there is provided another tool-holding unit with associated brush, generally fixed, designed to remove excess glue and unsightly ripples in the upper present in particular opposite the toe and heel.

Such carding machines have various shortcomings due mainly to the need for moving two members, i.e. the carriage which carries the upper and the tool-holding arm which carries the brush.

Movement of the two members leads to considerable construction complexity of the carding machine.

SUMMARY OF THE INVENTION

The object of the present invention is to eliminate the above mentioned shortcoming.

In accordance with the present invention this and other objects are achieved by a carding machine in which, in its general aspect, the back of the footwear being processed is moved only by a carriage on which it is fixed, the arm bearing the card is held fixed and the card is rotated with automatic rotation reversal.

In addition, in the carding machine of the present invention the speed of processing of the various portions of the footwear back can be adjusted in accordance with processing requirements.

The advantages achieved by the present invention consist in the first place of the fact that the complete machine is easy to manufacture. Operation in a more or less marked manner on the footwear back is possible by holding the tool positioned for a programmable time period at the areas where considerable rubbing is necessary.

Reversal of the rotation direction of only the card also eliminates the need for moving the support on which the footwear back is fixed and the tool-holding arm.

BRIEF DESCRIPTION OF THE DRAWINGS

These and other specific characteristics of the carding machine in accordance with the present invention are clarified by the description given below in which reference is made to the figures in the annexed drawings representing a preferred non-limiting embodiment of said machine wherein.

FIG. I shows a schematic side view of the carding machine of the present invention.

Figure 1:
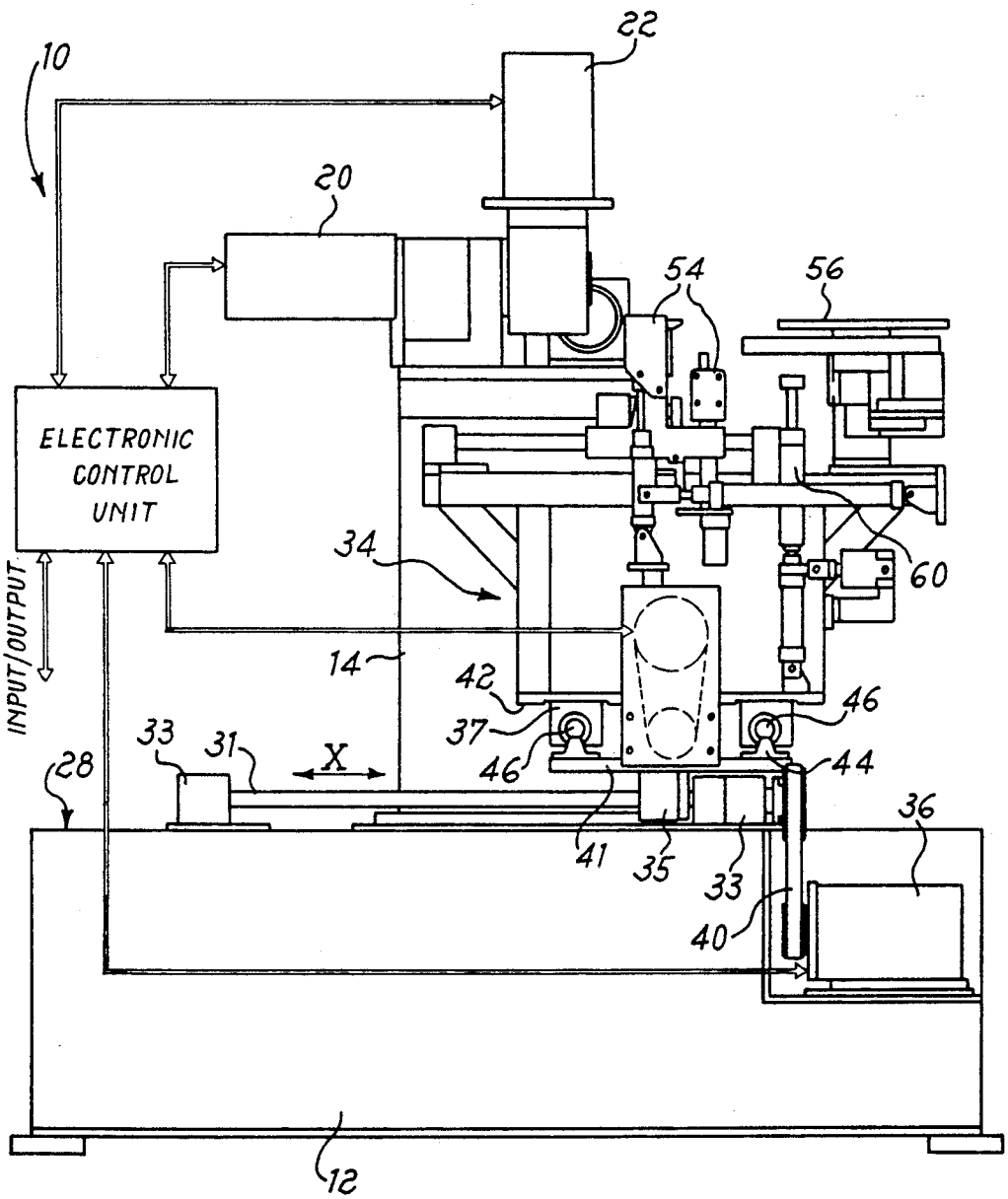
Figure 2:
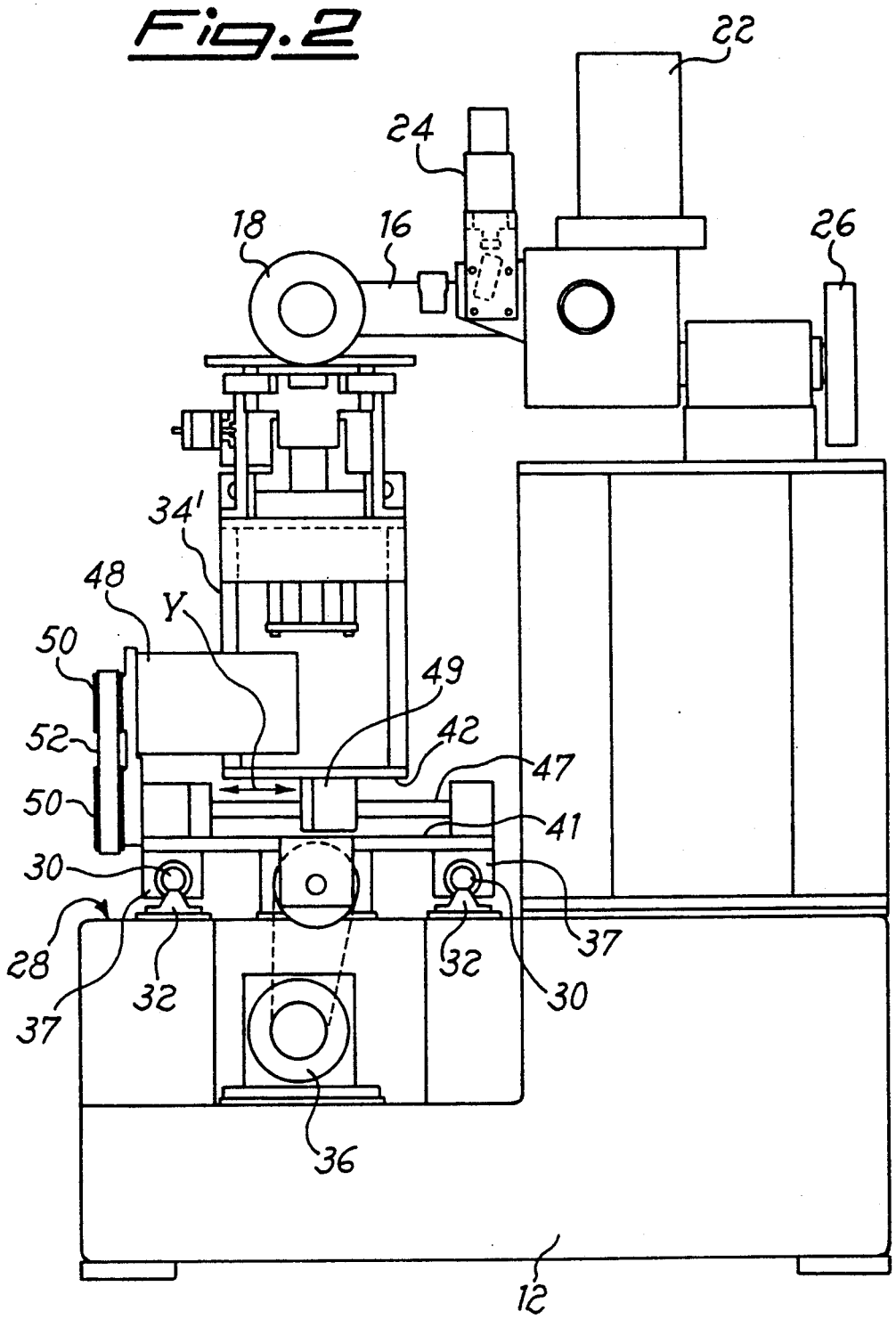
FIG. 2 shows a front view of the machine of FIG. 1.

With reference to the figures the improved machine for automatic carding of footwear uppers and the like indicated as a whole by reference number (10) comprises essentially a bed (12), a turret (14) which develops upward and a tool-holding unit designed to perform the carding or scraping operation on the footwear back and arranged on the top of said turret (14).

Said tool-holding unit consists essentially of an arm (16) bearing at its free front end the card (18), a pair of motors (20) and (22) used for movement of the card (18) and its regulation in the vertical direction, or a compressed air cylinder (24) acting on said arm (16) and allowing adjustment of the pressure of the card (18).

A pulley (26) connected to a motor (21) provides for initial inclination of the card (18) which, in the course of the scraping operation, is free to oscillate to adapt itself to the upper.

The card (18) can be rotated clockwise or counter clockwise by the motor (20) and can automatically reverse its direction of rotation.

Adaptation of the card (18) to the inclination of the footwear back takes place automatically, the inclination values of the axes being memorized in the central control unit of the machine but not illustrated in the figures because of known type.

On the top (28) of the bed (12) are arranged two first parallel guides (30) preferably consisting of as many shafts or feed rods extended longitudinally and made integral with the base top (12) by supporting blocks (32).

On the said guides (30) is arranged a carriage indicated as a whole by reference number (34) which runs thereon longitudinally along the X axis guided on ball bushings or the like (37). The carriage (34) is moved along the guides (30) by a motor (36) which, through the belt (40), activates a ball-recycling screw (31) supported on blocks (33) and the lead nut (35).

The carriage (34) comprises an upper sector (34'). The upper sector (34') runs, in relation the lower portion, along a transverse axis perpendicular to that on which the carriage (34) runs.

For this purpose, the top surface (41) of the carriage base is equipped with supporting blocks (44) similar to those indicated above by (32) provided with adequate seats for additional second guides (46) perpendicular to the first guides (30) and on which runs transversely along the Y axis the top sector (341) of the carriage (34). The carriage (34) therefore has a structure made up of two sectors arranged on two overlying levels of which the top sector (341) can be moved transversely along the Y axis simultaneously with the longitudinal travel along the X axis of the entire carriage (34).

Transverse movement of the top sector (34') is achieved similarly to the movement of the carriage (34) along the X axis by means of a motor (48) or equivalent which through pulleys (50) and belts (52) activates a recirculating ball screw (47) supported by a block (49) fixed to the lower surface (42) of the carriage (34').

The carriage (34) and the top sector (34') are moved independently at adjustable, programmable speed in such a manner that the intervention of the card can take place in a variable and adjustable manner on the different peripheral portions of the upper.

Figure 3:
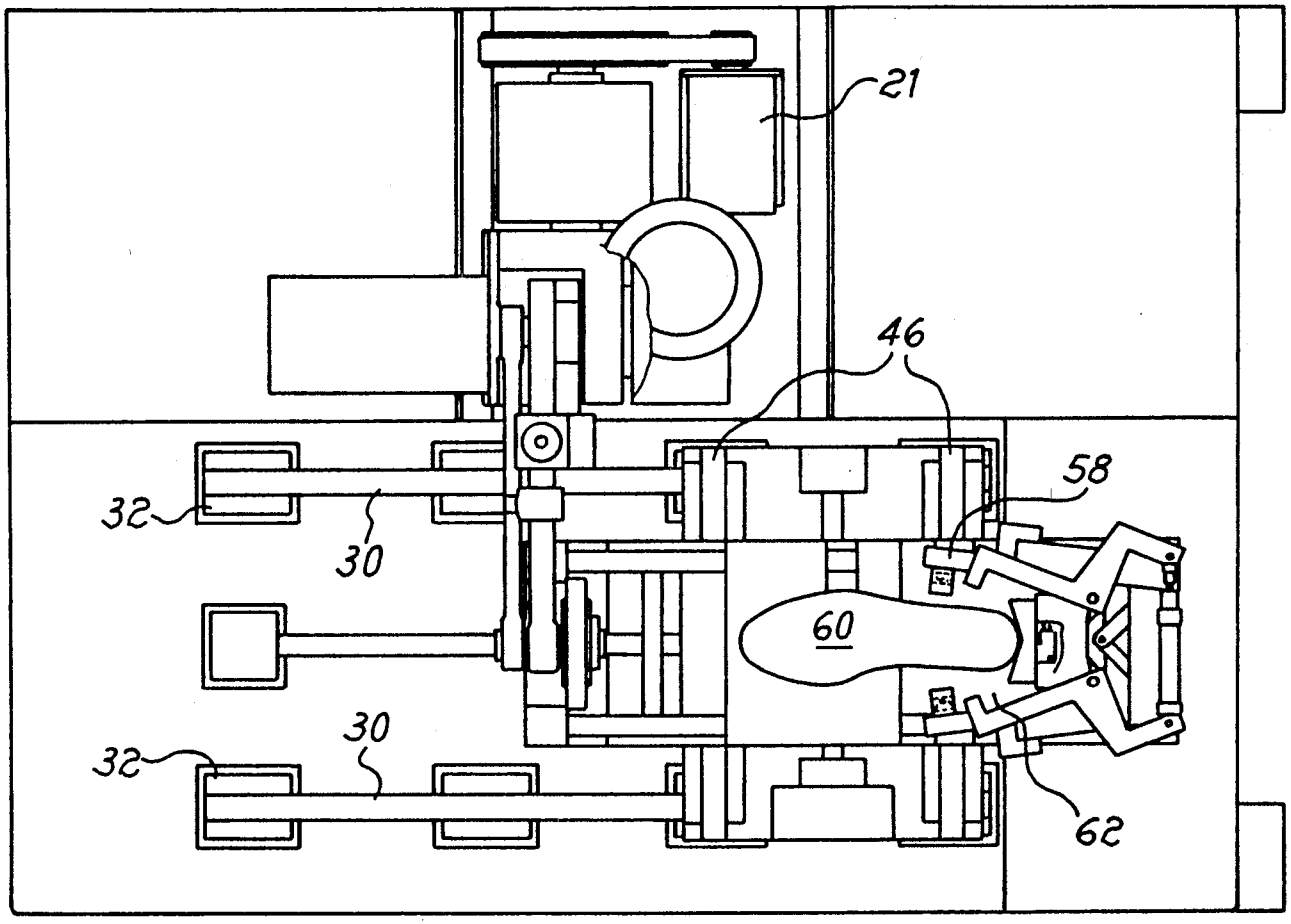
FIG. 3 shows a plan view of the machine of FIGS. 1 and 2 to show the movement system for the upper-carrying carriage.

The carriage (34) comprises other members of known type (54) and (56) which provide for appropriate adjustments on the basis of the length of the upper to be processed and correct arrangement upward thereof. FIG. 3 also illustrates the complete unit which oversees blocking of the upper in the form of a clamp (58) as well as support (60) for the upper born by the plate (62).

The adjustment members (54) and (56) and fixing members (58) and (60) are of known type and therefore are not described in detail in the present invention.

Operation of the carding machine of the present invention is now described.

The upper to be scraped is arranged on the support (60) and blocked by the clamp (58). The card (18) which intervenes on the entire periphery of the upper for appropriate smoothing is rotated by the motor (20). The carriage (34) is then made to travel along the guides (30) to progressively lead the upper under the card (18) in rotation.

Simultaneously the upper sector (341) of the carriage (34) is moved along the Y axis travelling on the guides (46). This allows carding on both versants of the upper as well as on the toe and heel portions. In this phase, to have the back of the footwear always roughened from the outside inward, the card (18) automatically reverses its direction of rotation by means of its own motor (20).

It is advantageously provided that movement of the carriage (34) and the top sector (341) thereof be programmable as to speed to allow the card (18) to stop for a longer period opposite specified points of the footwear back which require deeper scraping.

Speed control is provided by an electronic control unit in which can be memorized a variety of programs for as many types of footwear backs dimensionally different and/or which require specific operations.

The electronic programming control unit can be of any known type. As may be seen by the foregoing remarks the numerous advantages of the carding machine of the present invention are evident.

The carding machine allows performance of planned and effective operations on the uppers optimizing processing times on the basis of possible variation of translation speed along the perpendicular X and Y axes of the carriage (34) which leads the footwear backs under the card (18).

The machine also has characteristics of structural simplicity, the conventional movement of the arm bearing the card or brush for the scraping being eliminated.

Particularly advantageous is the ability to reverse the direction of rotation of the card to perform roughening of the footwear back always from the outside inward. This setting, indeed, eliminates the need to rotate the entire support bearing the upper to be processed or move along an axis the card-holding arm or rotate it along the longitudinal axis.

The invention as described and claimed is proposed merely by way of example and could be subjected to numerous modifications or variants all falling with in the scope of the inventive concept.

We claim:

1. A machine for automatically carding an upper of footwear, said upper having a back, said machine comprising a bed (12), a turret (14) overlying said bed, said turret having a top, a tool-holding unit arranged on said top of said turret, said tool-holding unit comprising a fixed arm (16) having a free front end, said arm bearing a card (18) at said front end of said arm, a first and a second motor (20,22) for movement of said card in the vertical direction, said bed (12) having a top, first parallel guides (30) arranged on said top of sag bed, a carriage (34), the back of said upper being arranged on said carriage, said carriage being arranged on said first parallel guides and running longitudinally thereon, said carriage having a top sector (34'), a pair of second guides (46) arranged perpendicularly to said first guides and constrained to said carriage (34), said upper sector (34') being movable transversely on said second guides, whereby said carriage (34) and said top sector (34') move independently.

2. The machine in accordance with claim 1 wherein said card (18) is rotated clockwise or counterclockwise by said first motor (20) to perform on said back of said upper of said footwear removable constantly directed from eh outside inwardly.

3. The machine according to claim 1 wherein said bed (12) has first blocks (32) at the top thereof, said carriage (34) has a top surface, said top surface having second blocks (44) and wherein said first and second guides (30), (46) comprise means for engaging with said blocks (32,(44) respectively.

4. The machine according to claim 3 wherein said means are shafts.

5. The machine according to claim 3 wherein said means are feed rods.

6. The machine according to claim 1 wherein said carriage (34) and said top sector (34') are moved at adjustable speed during travel and programmable by independent third and fourth motors (36), (48).

7. The machine according to claim 1 which comprises an electronic control unit in which are memorized the associated parameters on the basis of the type of the back of said footwear to be processed whereby longitudinal and transverse travel speed changes of the carriage (34) and of the top sector (34') are controlled.

8. The machine according to claim 7 wherein said longitudinal and transverse travel of said carriage (34) and said top sector (34') lead said upper of said footwear under the card (18) which performs scraping on the entire peripheral portion of said back of said upper.

9. The machine according to claim 7 wherein said back of said upper inclines, the inclination has an axis, said inclination has a value, said electronic control unit has memorized therein said value and said card (18) is automatically adapted to said inclination of said back of said upper.

* * * * *